US005464624A

United States Patent [19]

Isbell

[11] Patent Number: 5,464,624

[45] Date of Patent: Nov. 7, 1995

[54] METHOD FOR LOADING A DELIVERY SYSTEM FOR A CHEMICAL REPELLANT COMPOSITION

[76] Inventor: Arthur F. Isbell, 800 Delma Cir., Bryan, Tex. 77802

[21] Appl. No.: 992,709

[22] Filed: Dec. 18, 1992

[51] Int. Cl.[6] ..... A61K 31/165

[52] U.S. Cl. ..... 424/405; 424/43; 514/627; 514/818; 514/920; 252/301.16

[58] Field of Search ..... 424/45, 44, 43, 424/405; 514/957, 627, 818, 920; 252/305, 301.16

[56] References Cited

U.S. PATENT DOCUMENTS

| | | | |
|---|---|---|---|
| 4,186,851 | 2/1980 | Cantor | 222/113 |
| 4,213,875 | 7/1980 | Isbell | 252/188.3 R |
| 4,313,958 | 2/1982 | LaHann | 514/627 |
| 4,338,465 | 7/1982 | Isbell | 568/69 |
| 4,816,260 | 3/1989 | Wollrich | 514/920 |
| 4,997,853 | 3/1991 | Bernstein | 514/626 |

FOREIGN PATENT DOCUMENTS 1113863 12/1981 Canada .

OTHER PUBLICATIONS

Isbell, A. F. et al., "Device For Preventing Physical Attacks", 3 pages, (prepared more than one year before filing application Ser. No. 07/992,709).

*Primary Examiner*—Raj Bawa
*Attorney, Agent, or Firm*—Vaden, Eickenroht, Thompson & Feather

[57] ABSTRACT

A method is provided for loading a delivery system for a chemical repellant composition. An aqueous mixture comprising one part water-soluble isothiuronium salt and two parts weak base is prepared. Capsaicin is added to the aqueous mixture before it is loaded into the delivery system. A fluorescent compound, such as dichlorofluorescine, may also be added to the aqueous mixture and capsaicin before loading the delivery system.

21 Claims, No Drawings

METHOD FOR LOADING A DELIVERY SYSTEM FOR A CHEMICAL REPELLANT COMPOSITION

BACKGROUND OF THE INVENTION

1. Field of the Invention

This invention relates generally to self defense devices, and more specifically to a method for loading a chemical repellant composition into an aerosol container or other delivery system.

2. Description of the Prior Art

Assault and physical attacks on members of the public have increased dramatically in recent years. Many methods for preventing or deterring such attacks are available, however, such methods are frequently dangerous, or for other reasons, undesirable to the user and to the general public. For example, guns are frequently carried for protection purposes. However, guns are bulky and may cause serious injury to the person being attacked and to their friends, as well as to an attacker. Additionally, the carrying of a firearm or other weapon is unlawful in many areas.

Tear gas and other chemical spray defense devices have been developed for purposes of repelling and deterring attackers. However, tear gas is only moderately effective as a deterrent to attacks and it may cause permanent damage to the eyes and sensitive nasal tissues of the user and the attacker. Furthermore, as with the carrying of weapons, chemical repellants and devices are now illegal in some areas.

Ground red pepper and an extract of the fruit of the Capsicum family of plants are known for being effective for use as deterrents to attackers. The active ingredient of ground red pepper and the Capsicum extract is capsaicin. This substance produces a burning sensation and tearing when it comes into contact with the eyes or sensitive areas of the nose of humans. Capsaicin has also been shown to be an effective irritant to animals, such as carnivores, which do not have tear ducts. The irritation produced by capsaicin can be severe, however, the effects produced last only a few minutes. Additionally, capsaicin is a non-volatile substance, therefore, it must directly contact the eyes, nose, or at least the face, for any deterring effects and irritation to be produced. Despite the severe effects produced by capsaicin, its short-term effectiveness as a deterrent to attacks limits its use as a chemical repellant.

Crotyl mercaptan (trans-2-butenyl-1-thiol), commonly known as natural skunk scent, is also known to deter both human and animal attackers. The mercaptan does not produce prolonged irritation or permanent injury to the eyes or skin. Deterring effects are a result of its strong, unpleasant odor. The strong odor produced by crotyl mercaptan is readily absorbed by porous materials, and is extremely difficult to remove, thereby forcing an attacker to flee. Natural or synthetic crotyl mercaptan may be used as a chemical deterrent to attacks, however, to obtain large amounts of natural skunk scent would be impractical. Therefore, it is most desirable to utilize synthetic skunk scent, or crotyl mercaptan, as a component of a chemical repellant.

Chemical repellant compositions containing both capsaicin and crotyl mercaptan produce a combined "burning" irritation and strong odor effective for repelling and deterring attackers. The combination of the two substances is a desirable chemical repellant since both substances are non-toxic, naturally occurring materials that will not produce long-term or injurious effects on an attacker, however, will effectively deter an attacker. The use of natural crotyl mercaptan in an attack repellant has been limited by the difficulty in the handling and loading of the mercaptan into an aerosol container or other delivery system. The strong, often characterized as repulsive, odor and its lingering presence necessitate that exposure to mercaptan be minimized. The handling of crotyl mercaptan is made more difficult if it is to be mixed with capsaicin before loading the composition into a suitable delivery system to use for repelling potential attackers.

The use of synthesized crotyl mercaptan in chemical repellant compositions present the same difficulties as experienced when handling the natural substance. Although synthetic crotyl mercaptan has been produced by mixing crotyl isothiuronium salt and strong base, the odor production is rapid and extensive. Therefore, adding other compounds or loading a repellant delivery system is difficult to accomplish in the presence of the strong odor. An additional disadvantage to using synthetic crotyl mercaptan in a chemical repellant system is that known methods for synthesizing the compound require a strong base, such as sodium hydroxide, to drive the formation of the compound from isothiuronium salt. The strong base poses serious threats of injury not only to the attacker, but to the user of such a repellant as well.

No satisfactory methods for quick and effective removal or destruction of the odors from mercaptans are known. Mercaptans evaporate and oxidize by atmospheric oxygen slowly, and often are detectable in the same location over a period of months. Chemical oxidizing agents such as chromate and permanganate salts, convert mercaptans to water-soluble and nearly odorless products, but their chemical reactivity is difficult to control. Other oxidants, such as peracids and their salts, effectively convert mercaptans to water-soluble and odorless oxidation products having low toxicity, but many of these compounds are relatively expensive and the acidic and salt products are generally corrosive to sensitive parts of the eyes, nose and face.

Therefore, it is an objective of the present invention to provide a method for loading a chemical repellant composition comprising a substance having a strong, skunk-like odor, and capsaicin, and other compounds, into a delivery system.

It is another object of the present invention to provide a self-defense chemical repellant, comprising a strong, skunk-like odor, capsaicin, and an identification means invisible to the attacker, but detectable under ultraviolet light.

It is yet another object of the present invention to provide a method of quickly and thoroughly removing a strong, skunk-like odor from skin and porous materials.

SUMMARY OF THE INVENTION

According to the present invention, a method is provided for loading a delivery system for a chemical repellant. The delivery system is loaded by preparing an aqueous solution of water-soluble isothiuronium salt and preparing a weak base. The crotyl isothiuronium salt solution and the weak base are combined to form an aqueous mixture. Capsaicin is added to the mixture. The aqueous mixture and capsaicin is then loaded into a delivery system. In a preferred embodiment of the present invention, one part of approximately 0.50 molar crotyl isothiuronium chloride solution is combined with two parts of 0.25 to 0.50 molar weak base solution. The weak base may be selected from the group consisting of carbonate, bicarbonate, or a mixture thereof. In another embodiment, an organic solvent is added to the aqueous mixture at approximately 5–10% by volume of the mixture. A fluorescent compound, such as dichlorofluorescine, may also be added to the aqueous mixture and capsaicin before loading the delivery system. Once loaded, the delivery system is sealed and pressurized. A chemical repellant composition comprising an aqueous mixture comprising a water-soluble isothiuronium salt and a weak base, capsaicin, a fluorescent compound, and an organic solvent is also provided.

A method is provided for rapidly destroying mercaptan compounds absorbed into a porous material. A solution comprising a peroxy compound present at from approximately 1% to 10% by volume of the solution is applied to mercaptan compounds absorbed into porous material. The solution destroys the mercaptan compounds, thereby eliminating the strong odor associated with the compounds. The porous material is then flushed with water or additional peroxy-containing solution.

DETAILED DESCRIPTION OF THE INVENTION

The inventive method is for loading a delivery system for a chemical repellant. A preferred chemical repellant composition loaded into the delivery system comprises an aqueous mixture of a water-soluble isothiuronium salt and a weak base which produces a strong, skunk-like odor, and capsaicin. The invention provides a method for combining the components of the chemical repellant delivery system without exposure to the strong skunk-like odor during the preparation.

In a preferred embodiment of the present invention, an aqueous 0.5 molar solution of trans-crotyl isothiuronium chloride is prepared as described in U.S. Pat. No. 4,213,875, Synthesized Scent, Jul. 22, 1980, and U.S. Pat. No. 4,338,465, Synthesized Scent, Jul. 6, 1982, incorporated herein by reference. Trans-crotyl isothiuronium chloride is the preferred salt for use with the invention, however, other isothiuronium salts, such as ethyl isothiuronium chloride, propyl isothiuronium chloride and butyl isothiuronium chloride and their isomers may be utilized with the invention. Mixtures of these compounds may also be used with the invention. The compounds will produce the corresponding mercaptan products in the presence of a weak base, which will emit strong odors. Analogs of the chloride salt, such as, trans-crotyl isothiuronium bromide, may also be utilized with the invention.

A weak base is prepared using any of the commonly available carbonates or bicarbonates, or combination thereof. The weak base drives the production of mercaptan products from the isothiuronium salt. It is the production of the mercaptans which results in the strong, generally unpleasant, odor and which is of beneficial use in chemical repellants. The pH of the base must be great enough to produce the maximum amount of mercaptan available from the isothiuronium salt, however, it should not be great enough to allow the reaction resulting in the production of mercaptans to begin immediately upon introduction of the base or to proceed rapidly. Slowing or delaying the production of mercaptan from isothiuronium salt in the presence of the weak base provides time for adding additional compounds to the salt and base mixture, as well as providing time for properly loading a chemical repellant delivery system before the strong mercaptan odor becomes detectable.

In a preferred embodiment of the present invention, sodium bicarbonate is used to prepare the weak base. In another preferred embodiment, sodium carbonate is used to prepare the weak base. Preferred weak base solutions have a pH of approximately 8.0 to 11.6. For example, a 0.5 molar solution of sodium bicarbonate will have a pH of approximately 8.0. A 0.25 molar solution of sodium carbonate solution will have a pH of approximately 11.6. The production of the mercaptans can be delayed by controlling the pH of the weak base. Increasing the pH of the base solution, within the 8.0 to 11.6 range, in the presence of a constant concentration of crotyl isothiuronium chloride will decrease the amount of time available for loading the delivery system before mercaptan odor becomes detectable.

An aqueous mixture is prepared by combining 1 part transcrotyl isothiuronium chloride solution and 2 parts weak base solution. Once the aqueous mixture is prepared, an extract of the Capsicum family of plants, which contains capsaicin is added. Humans and animals vary in their reaction to capsaicin, therefore, various amounts of capsaicin may be used. In a preferred embodiment of the present invention, approximately 0.15 to 1.5 milligrams (mg) of capsaicin will be added to a 15 milliliter (ml) volume of the aqueous mixture to form a chemical repellant.

An organic solvent is added to the chemical repellant at approximately 5–10% by volume. Organic solvents such as ethanol, isopropanol, glycerol, propylene glycol, diethylene glycol or similar polar solvents possessing low toxicities may be utilized. Organic solvents are added to the chemical repellant to improve the water solubility of capsaicin and the mercaptans produced. The improved water-solubility of the compounds facilitate even dispersement of the chemical repellant from the delivery system.

In another preferred embodiment of the inventive method, a fluorescent compound or other substance having dye-like properties is added to the chemical repellant prior to loading the repellant into the delivery system. Fluorescent compounds, such as dichlorofluorescine, which produce a fluorescent glow under ultraviolet light provide a means in addition to the strong mercaptan odor by which to identify an alleged attacker if he is apprehended within a reasonable amount of time. Such compounds are detectable when present in at amounts of approximately 0.0001% of the chemical repellant. In a preferred embodiment, the dye compound will be added at an amount of approximately 0.01% of the chemical repellant.

It is preferred that the chemical repellant is loaded into a cartridge or an aerosol-type delivery system. Following loading, the delivery system is sealed. A pressurizing gas may be added immediately following the sealing of the system, or the system may be pressurized after the maximum amount of mercaptan has formed. Pure nitrogen gas is preferred for use for pressurizing the delivery system immediately after loading the system. Carbon dioxide gas may be used for pressurizing the system after the formation of mercaptan has been completed. Pure oxygen or oxygen containing gases should not be used to pressurize the delivery system as elemental oxygen will oxidize the formed mercaptans.

Once a person or porous material has been sprayed or in other way exposed to crotyl or other mercaptans, the odor can be removed utilizing a peroxy-containing solution. A preferred method for removing mercaptan odor is to apply a solution comprising a peroxy compound present at from 1% to 10% of the solution to the area of the body or porous material exposed to the mercaptan compounds. The peroxy-compounds will oxidize the mercaptans to odorless compounds. Flushing the area of the porous material exposed to the mercaptan compounds with the peroxy solution or water will remove the oxidation products. In a preferred embodiment, 3% hydrogen peroxide solution is utilized as described to quickly and effectively remove mercaptan odor. Any excess peroxide decomposes into gaseous oxygen and water, leaving no undesirable residue. Sodium monoperoxysulfate, which reacts similarly to hydrogen peroxide, is also highly water soluble and can be successfully used to breakdown mercaptans.

Example 1 and 2 describe preferred embodiments of the inventive method.

EXAMPLE 1

A 5 ml quantity of a 0.5 molar aqueous solution of transcrotyl isothiuronium chloride is mixed with 10 ml of 0.5 molar aqueous sodium bicarbonate solution to form an aqueous mixture. At 25° C., crotyl mercaptan odor is detectable approximately 30 minutes after preparing the aqueous mixture. Thereafter, crotyl mercaptan, and the associated odor, production increases slowly to a maximum at approximately 24– 48 hours following mixture preparation. During this time, the solution becomes cloudy because of the separation of oily droplets from the slightly water-soluble crotyl mercaptan. The addition of approximately 1.5 ml of an organic solvent discussed above produces an essentially clear solution. Approximately 0.15–1.5 mg of capsaicin, and approximately 15 mg of dichlorofluorescine is added to the mixture. The 30 minute delay in detectable odor formation provides adequate time in which to load the repellant composition into the appropriate delivery system. The delivery system is sealed and pressurized as described above.

EXAMPLE 2

A 5 ml quantity of a 0.5 molar aqueous solution of transcrotyl isothiuronium chloride is mixed with 10 ml of a 0.25 molar aqueous solution of sodium carbonate. At 25° C., mercaptan odor is detectable after approximately 5 minutes. Thereafter, crotyl mercaptan, and the associated odor, production increases to a maximum at approximately 6–8 hours following mixture preparation. As discussed in Example 1, oil droplets will separate from the crotyl mercaptan produced. The addition of approximately 1.5 ml of an organic solvent discussed above produces an essentially clear solution. Approximately 0.15–1.5 mg of capsaicin, and approximately 15 mg of dichlorofluorescine is added to the mixture. The 5 minute delay time would allow this solution to be enclosed in a delivery capsule before any significant undesirable odor formation. The same delivery system pressurizing procedures as described in Example 1 can be used.

While particular embodiments of the invention have been shown, it will be understood that the invention is not limited thereto. As will be apparent to those of ordinary skill in the art, other variations, alternatives, substitutions and equivalents may be applicable to the various embodiments disclosed herein.

What is claimed is:

1. A method for loading a delivery system for a chemical repellant consisting essentially of the steps of:

(a) preparing an aqueous solution of a water-soluble isothiuronium salt;

(b) preparing a weak base selected from the group consisting of carbonates, bicarbonates, and combinations thereof and having a pH of between approximately 8.0 and 11.6;

(c) combining the aqueous solution of isothiuronium salt and the weak base to form an aqueous mixture of the aqueous solution of isothiuronium salt and the weak base;

(d) adding capsaicin to the aqueous mixture of the aqueous solution of isothiuronium salt and the weak base to form the chemical repellant;

(e) loading the chemical repellant into the delivery system; and (f) sealing the delivery system.

2. The method of claim 1, wherein the water-soluble isothiuronium salt is present in approximately 0.5 molar concentration.

3. The method of claim 1, wherein the weak base is present in approximately 0.25 to 0.5 molar concentration.

4. The method of claim 1, wherein the aqueous mixture of the aqueous solution of isothiuronium salt and the weak base comprises 1 part water-soluble isothiuronium salt and 2 parts weak base in a 1 to 2 chemically equivalent ratio.

5. The method of claim 1, wherein the water-soluble isothiuronium salt is selected from the group consisting of crotyl isothiuronium chloride, methyl isothiuronium chloride, ethyl isothiuronium chloride, propyl isothiuronium chloride, butyl isothiuronium chloride, amyl isothiuronium chloride, allyl isothiuronium chloride, benzyl isothiuronium chloride, crotyl isothiuronium bromide, and isomers of isothiuronium chloride salts, and combinations thereof.

6. The method of claim 1, wherein the water-soluble isothiuronium salt is trans-crotyl isothiuronium chloride.

7. The method of claim 1, wherein a fluorescent compound is added to the chemical repellant before loading the delivery system.

8. The method of claim 7, wherein the fluorescent compound is dichlorofluorescine added at approximately 0.01% by volume of the chemical repellant before loading the delivery system.

9. The method of claim 1, wherein the weak base is sodium bicarbonate present in approximately 0.5 molar concentration.

10. The method of claim 1, wherein the weak base is sodium carbonate present in approximately 0.25 molar concentration.

11. The method of claim 1, wherein an organic solvent is added to the chemical repellant at approximately 5–10% by volume of the repellant composition.

12. The method of claim 11, wherein the organic solvent is selected from the group consisting of ethanol, isopropanol, glycerol, propylene glycol, and diethylene glycol.

13. The method of claim 1, further comprising pressurizing the delivery system after it is sealed.

14. A chemical repellant composition consisting essentially of:

(a) an aqueous mixture comprising an aqueous solution of water-soluble isothiuronium salt and a weak base selected from the group consisting of carbonates, bicarbonates, and combinations thereof and having a pH of between approximately 8.0 and 11.6;

(b) capsaicin;

(c) an organic solvent selected from the group consisting of ethanol, isopropanol, glycerol, propylene glycol, diethylene glycol and combinations thereof present in the composition at approximately from 5% to 10% by volume of the composition; and (d) a fluorescent compound.

15. The composition of claim 14, wherein the water-soluble isothiuronium salt is present in approximately 0.5 molar concentration.

16. The composition of claim 14, wherein the weak base is present in approximately 0.25 to 0.5 molar concentration.

17. The method of claim 14, wherein the aqueous mixture of the aqueous solution of isothiuronium salt and the weak base comprises 1 part water-soluble isothiuronium salt and 2 parts weak base in a 1 to 2 chemically equivalent ratio.

18. The composition of claim 14, wherein the water-soluble isothiuronium salt is trans-crotyl isothiuronium chloride.

19. The method of claim 14, wherein the fluorescent compound is dichlorofluorescine present at approximately 0.01% by volume of the repellant composition.

20. The method of claim 14, wherein the weak base is sodium bicarbonate present in approximately 0.5 molar concentration.

21. The composition of claim 14, wherein the weak base is sodium carbonate present in approximately 0.25 molar concentration.

* * * * *